United States Patent [19]

Nakamura et al.

[11] 4,123,742

[45] Oct. 31, 1978

[54] VARIABLE RESISTOR

[75] Inventors: Moritoshi Nakamura, Miyagi; Jun Nakanowatari, Furukawa, both of Japan

[73] Assignee: Alps Electric Co., Ltd., Japan

[21] Appl. No.: 810,110

[22] Filed: Jun. 27, 1977

[30] Foreign Application Priority Data

Jul. 2, 1976 [JP] Japan ..... 51-87825

[51] Int. Cl.[2] ..... H01C 10/00

[52] U.S. Cl. ..... 338/137; 338/138; 338/183; 338/217; 338/287; 338/292; 338/293; 338/307; 338/308

[58] Field of Search ..... 338/137, 138, 128, 217, 338/218, 160, 142, 171, 176, 183, 188, 194, 202, 283, 285, 287, 292, 293, 300, 301, 307–309, 314; 29/610

[56] References Cited

U.S. PATENT DOCUMENTS

| | | | |
|---|---|---|---|
| 1,755,314 | 4/1930 | Carter | 338/218 |
| 3,703,699 | 11/1972 | Lahm et al. | 338/183 X |

OTHER PUBLICATIONS

Oelsch, K.G., German Printed Application No. 2508530, pub. 2/27/75, (8 pp. specs).

*Primary Examiner*—C. L. Albritton

*Attorney, Agent, or Firm*—Guy W. Shoup; Gerard F. Dunne

[57] ABSTRACT

A variable resistor has an insulating substrate plate, a resistance body formed on the substrate plate and a slider adapted to slide along the resistance body. The resistance body is formed in a winding pattern to provide a larger range of variation of resistance for a given stroke of the slider. The slider has a plurality of contacts adapted for sliding along the resistance body so that at least one of the contacts is kept in contact with the winding resistance body so as to provide a linear change of the output of the resistor.

2 Claims, 8 Drawing Figures

VARIABLE RESISTOR

BACKGROUND OF THE INVENTION

The present invention relates to variable resistors and, more particularly, to a mechanism enabling a sliding motion of a sliding element along a winding resistance body formed on an insulating substrate plate by such means as evaporation or printing techniques in a manner providing a linear output.

A conventional type of variable resistor has generally been constituted by forming a resistance body 3 on a substrate plate 1, as shown in FIG. 1. In order to obtain a larger changing rate for the value of the resistance, the resistance body 3 is typically made to extend in a winding or back and forth pattern over the path of a movable slider 4 adapted to slide along the central section of the sliding body 3, as shown by the broken lines.

Therefore, the output of the variable resistor varies inconveniently in a stepped manner in proportion to the distance travelled by the slider, as shown by a full line in FIG. 1, resulting in poor resolution.

It is therefore an object of the invention to overcome the above described shortcoming of the prior art.

The above and other object, as well as other advantages of the present invention will become more clear from the following description of a preferred embodiment taken in conjunction with the attached drawings in which:

BRIEF DESCRIPTION OF THE DRAWINGS

FIG. 3 to FIG. 7 show variable resistors of the present invention, wherein FIG. 3 is a plan view of one embodiment of the present invention, FIG. 4 is an enlarged sectional view of essential parts of the embodiment of FIG. 3, FIG. 5 shows another embodiment of the present invention, FIG. 6 is a graphical representation of output characteristics of a variable resistor in accordance with the present invention, and FIGS. 7A and 7B are illustrations showing further embodiments of the present invention.

DESCRIPTION OF THE PREFERRED EMBODIMENTS

Figure 3:
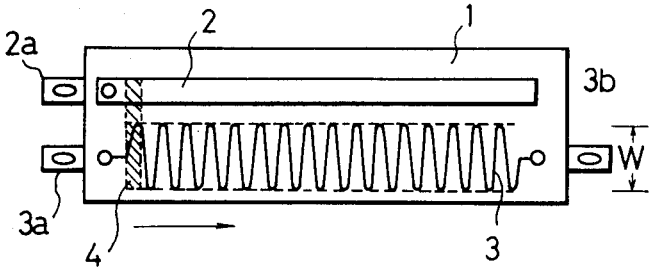

Referring to the drawings, especially to FIG. 3, a variable resistor embodying the present invention is shown to have an insulating substrate plate 1, a conductive body 2 made of silver paste or the like and provided at its intermediate portion with an intermediate terminal 2*a*, and a winding resistance body 3 having respective end terminals 3*a* and 3*b*.

The resistance body 3 is formed, by such means as evaporation or printing techniques, on the substrate plate 1 to extend generally parallel to the conductive body 2.

The variable resistor further has a slider 4 having a width slightly larger than the width (W) of the resistance body 3.

Figure 4:
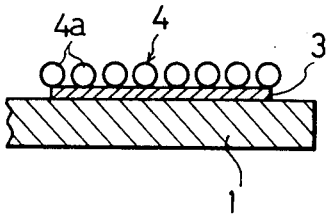

As will be seen best from FIG. 4 showing an enlarged view, the slider 4 is comprised of a plurality of contacts 4*a* adapted for contact with the resistance body 3.

Figure 1:
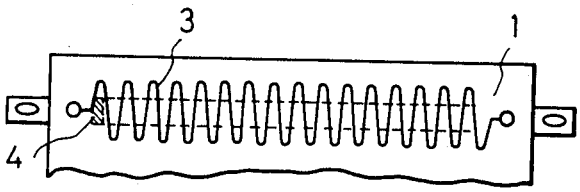
Fig. 1 PRIOR ART
FIG. 1 is a plan view of essential parts of a resistance body of a typical conventional variable resistor.
Figure 2:
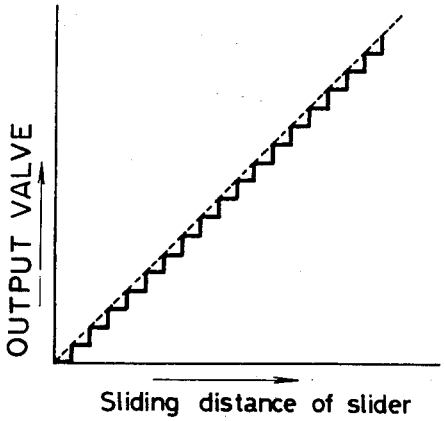
FIG. 2 is a graphical representation of output characteristics of variable resistors.

As the slider 4 is slidingly moved in the direction of the arrow along the resistance body 3, at least one contact of the slider will always be in contact with the resistance body 3, so that as the slider 4 is made to progress along the winding resistance body 3 it will always be in electrical contact therewith so as to provide linear output characteristics for the variable as shown by the broken line of FIG. 2.

Figure 5:
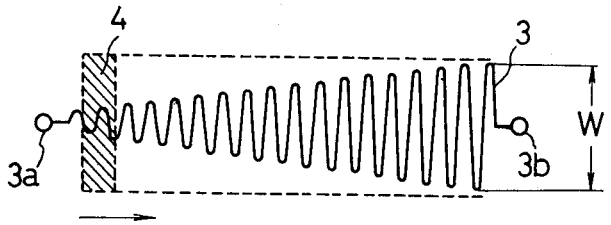

Referring to FIG. 5 showing another embodiment of the present invention width or amplitude of the winding pattern of the resistance body 3 is gradually or progressively changed from one end to the other end thereof. The slider 4 then would have a width larger than the maximum width (W) of the winding.

Figure 6:
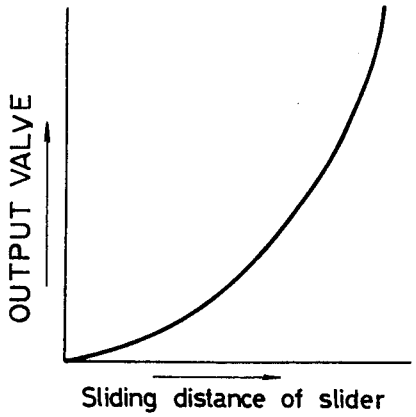

This arrangement provides smooth curved output characteristics as shown by FIG. 6, as the slider 4 moves along the output body 3, in the direction of the arrow.

Figure 7:
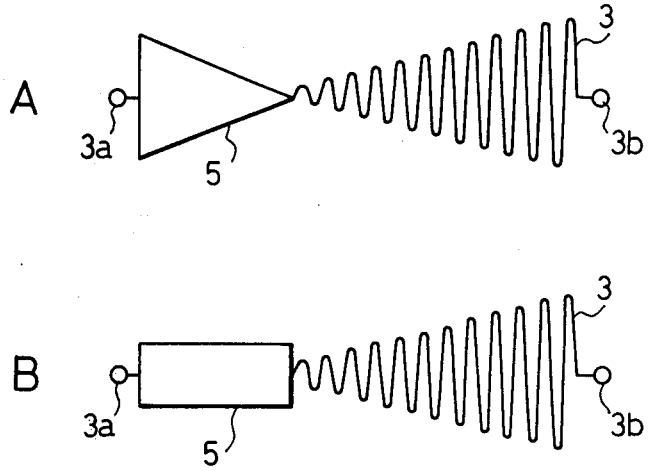

For obtaining a desired larger changing ratio of the resistance, the winding resistance 3 is connected at its one end to a triangular or rectangular resistance portion 5, as will be seen from FIGS. 7A and 7B.

As has been described, according to the invention, there is provided a variable resistance having an insulating substrate plate 1, a winding resistance body 3 formed on the substrate plate 1 and having its ends connected to respective terminals 3*a* and 3*a*, and a slide having a width larger than that of the winding of the resistance body and having a plurality of contacts 4*a* adapted for contact with the resistance body, whereby at least one of the contacts 4*a* maintains a contact with the resistance body 3, so as to provide smooth output characteristics, as well as a large changing ratio of the resistance.

Consequently, according to the invention, the resolution of the output voltage is remarkably increased, resulting in a highly practical effect.

For example, by using a resistance body 3 made of a thin film of gold and having a suitable winding width, the resistance value can be varied widely from several hundred ohms to several thousand ohms.

What is claimed is:

1. A variable resistor comprising:

a substrate plate formed from an electrically insulating material;

a resistance body formed in a back and forth winding pattern upon said substrate plate; and a slider adapted to be moved along said resistance body, said slider having a width at least as wide as the widest portion of said resistance body and being provided with a plurality of contacts arranged along its width whereby the contacts of said slider will maintain a continuous electrical contact traveling along the winding length of said resistance body as said slider is moved longitudinally along said winding resistance body.

2. A variable resistor according to claim 1, wherein the width of said resistance body varies in a longitudinal direction of said resistance body.

* * * * *